US007676973B1

(12) United States Patent
Powers

(10) Patent No.: US 7,676,973 B1
(45) Date of Patent: Mar. 16, 2010

(54) FIREARM OR REPEATING PYROTECHNIC MORTAR THAT ADVANCES CARTRIDGES FROM A MAGAZINE INTO A FIRING CHAMBER BY A CHEMICAL DETONATION OR STEAM EXPLOSION

(76) Inventor: James M. Powers, 3 Santa Lucia Ave., Ormond Beach, FL (US) 32174

( * ) Notice: Subject to any disclaimer, the term of this patent is extended or adjusted under 35 U.S.C. 154(b) by 0 days.

(21) Appl. No.: 12/460,070

(22) Filed: Jul. 13, 2009

Related U.S. Application Data

(63) Continuation-in-part of application No. 12/321,820, filed on Jan. 26, 2009.

(60) Provisional application No. 61/195,398, filed on Oct. 7, 2008.

(51) Int. Cl.
*F41A 9/61* (2006.01)

(52) U.S. Cl. ..... 42/49.01; 89/33.1; 42/17

(58) Field of Classification Search ..... 42/2, 42/17, 6, 49.01; 89/4.05, 33.01, 33.1
See application file for complete search history.

(56) References Cited

U.S. PATENT DOCUMENTS

| | | | | |
|---|---|---|---|---|
| 4,074,843 | A * | 2/1978 | Oesterle | 227/8 |
| 6,736,125 | B2 * | 5/2004 | Petrosyan et al. | 124/51.1 |
| 7,275,342 | B2 * | 10/2007 | Medvedeo | 42/19 |
| 7,500,421 | B2 * | 3/2009 | Becker | 89/33.14 |

* cited by examiner

*Primary Examiner*—J. Woodrow Eldred

(57) ABSTRACT

A method of loading individual caseless cartridges sequentially into a firearm firing chamber by the expansive force of a small detonation in the magazine focused locally on the current top cartridge in a magazine without damaging remaining cartridges. Small individual propelling charges containing an igniter microchip located in the magazine behind each cartridge provides the loading thrust. More energetic charges containing igniter microchips are imbedded in the cartridges to fire the cartridge in the firing chamber at will.

10 Claims, 7 Drawing Sheets

FIREARM OR REPEATING PYROTECHNIC MORTAR THAT ADVANCES CARTRIDGES FROM A MAGAZINE INTO A FIRING CHAMBER BY A CHEMICAL DETONATION OR STEAM EXPLOSION

CROSS REFERENCE TO RELATED APPLICATIONS

This is a continuation-in-part of prior application Ser. No. 12/321,820 "FIREARM OR REPEATING PYROTECHNIC MORTAR THAT ADVANCES LOADS FROM A MAGAZINE TO A RECEIVER BY A CHEMICAL DETONATION OR STEAM EXPLOSION", filed on Jan. 26, 2009 Provisional Application No. 61/195,398 filed on Oct. 7, 2008 by this inventor addresses explosively advancing cartridges from magazine into firing chamber.

BACKGROUND OF THE INVENTION

Semi-automatic or automatic firearms commonly strip cartridges from a magazine and insert them to a firearm firing chamber manually, by mechanisms energized by recoil or by a gas piston moved by gases bled from the firearm barrel. Where cased cartridges are used, extraction of the casing is by elaboration of the same mechanisms. Pyrotechnic mortars with the notable exceptions of Roman candles and fountains are typically single shot and not automatically loaded. MEMS detonators developed at Georgia Tech and utilizing RFID technology are exemplary of igniter microchips referenced in this application.

SUMMARY OF THE INVENTION

A method of loading individual caseless cartridges sequentially into a firearm firing chamber by the expansive force of a small detonation in the magazine focused locally on the current top cartridge in a magazine without damaging remaining cartridges. Small individual propelling charges containing an igniter microchip located in the magazine behind each cartridge provides the loading thrust. More energetic charges containing igniter microchips are imbedded in the cartridges to fire the cartridge in the firing chamber at will.

OBJECTS AND ADVANTAGES OF THE INVENTION

Objects and advantages of the invention are:

Objects and advantages of the invention are realized in a method of advancing caseless cartridges from a magazine into a firing chamber by means of a small explosion (a chemical or steam explosion) initiated electrically. Precisely applied small explosions drive nails, inflate air bags, and sever explosive bolts. Some advantages of explosive loading follow:

- Small explosions replace loading mechanisms, so moving parts are minimized.
- Rate of loading and firing can be increased by reducing mechanism inertia.
- A caseless cartridge eliminates the extraction cycle and lightens the ammunition burden.

DETAILED DESCRIPTION OF PREFERRED EMBODIMENTS

Figure 1:
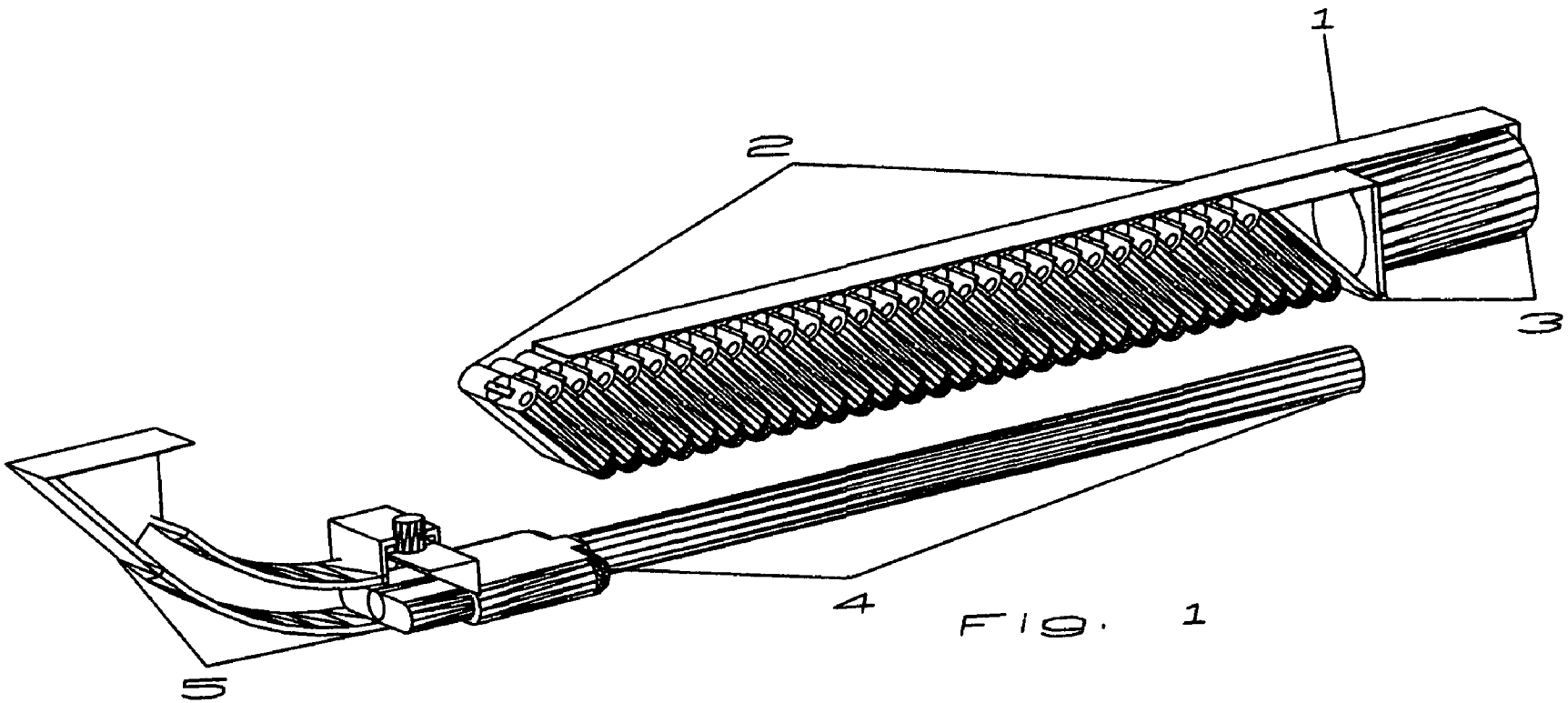
FIG. 1 is a representation of the firearm loading a first caseless cartridge into the firing chamber, but with the magazine withdrawn from the loading ramp to expose components.

A preferred firearm or repeating pyrotechnic mortar that loads individual caseless cartridges into a firing chamber by the expansive force of a small detonation in the magazine. In FIG. 1 said magazine (1) is cut away exposing magazine stack (2) and magazine spring with cartridge wedge (3). The magazine is shown parallel to barrel (4) but withdrawn from the loading ramp (5) to expose components.

Figure 2:
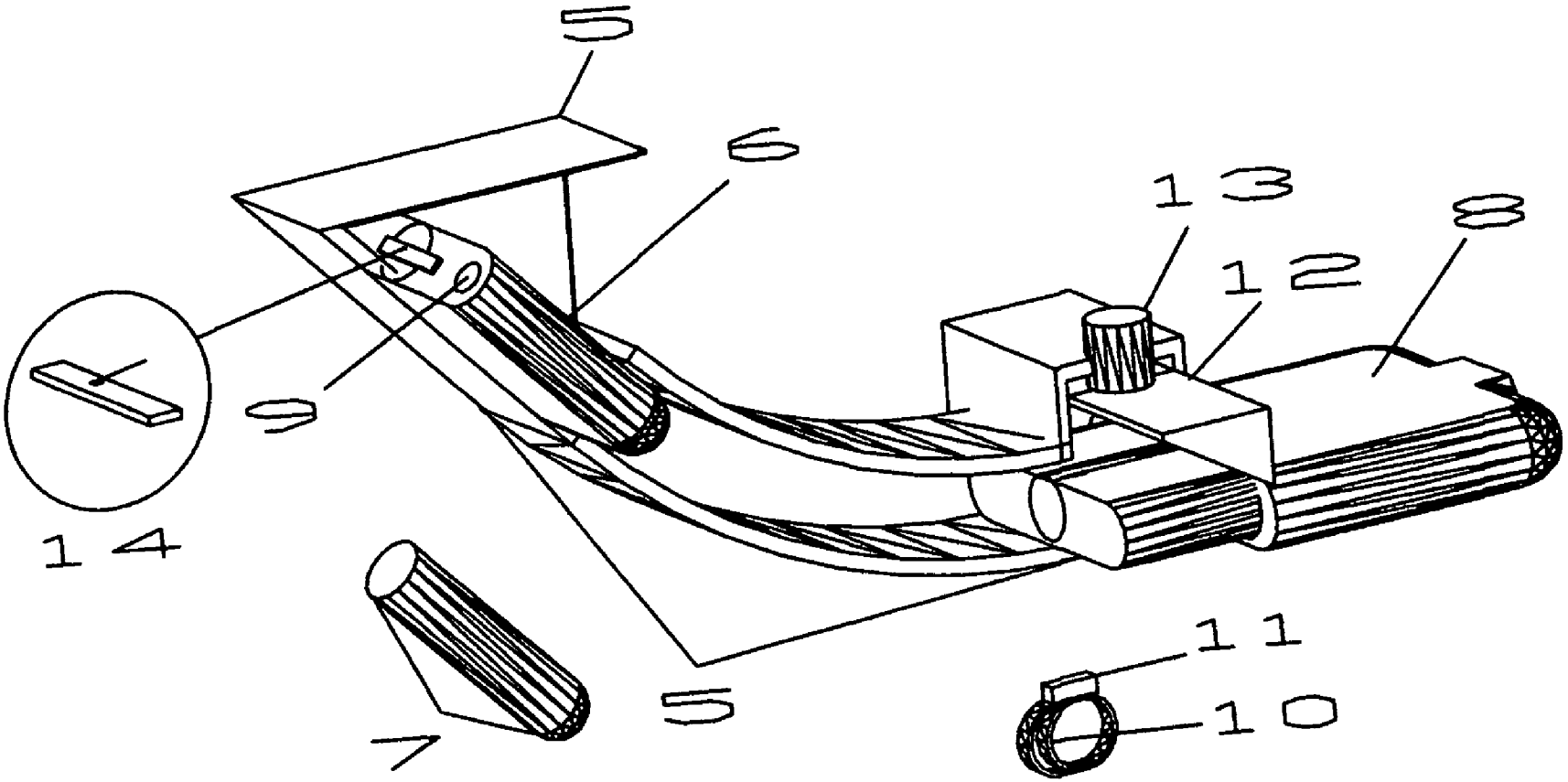
FIG. 2 is a representation of the loading ramp, breach block and firing chamber.

FIG. 2 shows details of loading ramp (5) and a caseless cartridge (6) with propellant encasing each projectile and propellant flattened about the projectile. The purpose of flattened propellant is to shorten the total cartridge stack to the limit presented by cylindrical projectiles (7) shown removed. The cartridges are angled toward the firing chamber (8). Small individual propelling charges (9) containing an igniter microchip are located on and behind each said cartridge. Said small charges detonate in the magazine focused locally on only the foremost cartridge in the magazine without damaging remaining cartridges. If trigger (10), shown separately, is pulled, a wireless sender (11) transmits an encrypted signal utilizing, for example RFID technology, to said charges to electronically ignite them in sequence to explosively thrust each subsequent foremost cartridge at will in a curved path within the curved loading ramp (5), into said firing chamber to be fired at will through the barrel. The explosively thrust cartridge nose pushes a breach block (12) upward by sheer momentum and passes into the firing chamber. The wedge shaped breach block is spring-biased closed (13) and drops after the cartridge passes to contain chamber pressure. More energetic charges with igniter microchips (in scaled popout 14) are embedded in each cartridge to fire cartridges loaded into the firing chamber.

Figure 3:
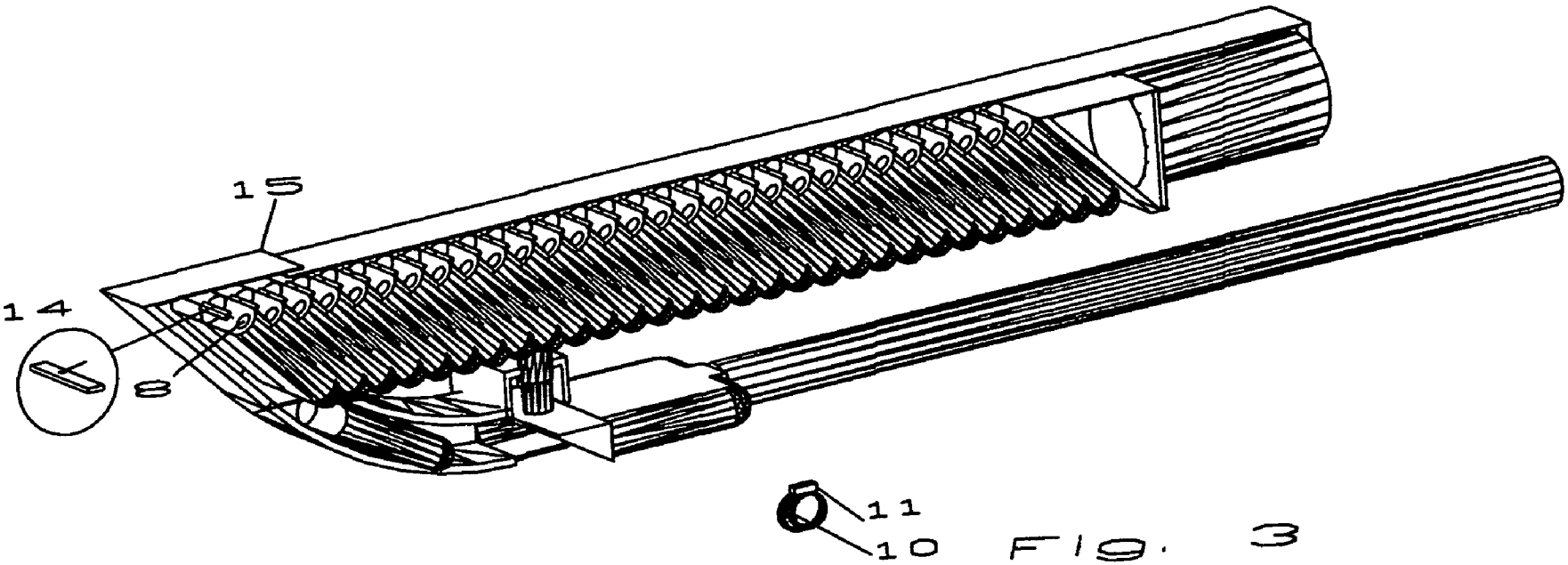
FIG. 3 is a representation of the firearm complete with a cartridge beginning a curved passage to the firing chamber while enclosed in a curved gas tight loading ramp.

FIG. 3 shows the firearm assembled, the magazine inserted into a gas tight seal (15) on the tubular loading ramp. Expanding loading gases are contained within the loading ramp long enough to protect the person operating the firearm.

DESCRIPTION OF OTHER EMBODIMENTS

Figure 4:
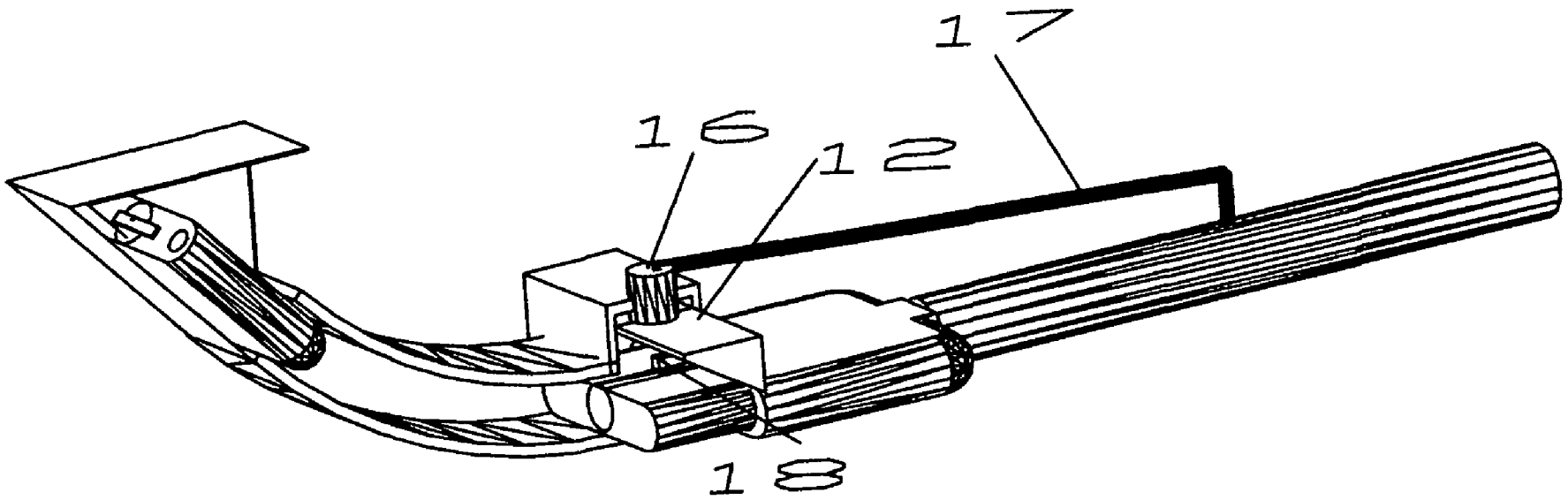
FIG. 4 is a representation of a breach block opened by a cylinder actuated by propellant gas tapped from the barrel and a cartridge tripping a sear allowing spring-loaded closure of the breach block.

The method (FIG. 4) detailed in the preferred embodiment but with the spring-loaded biased closed breach block (12) opened by a pneumatic actuator (16) actuated by propellant gas from the prior firing tapped from the barrel by tube (17) in a method common in firearm design. The breach block is released to close behind the cartridge by a sear (18) tripped by the cartridge when it seats into the firing chamber.

Figure 5:
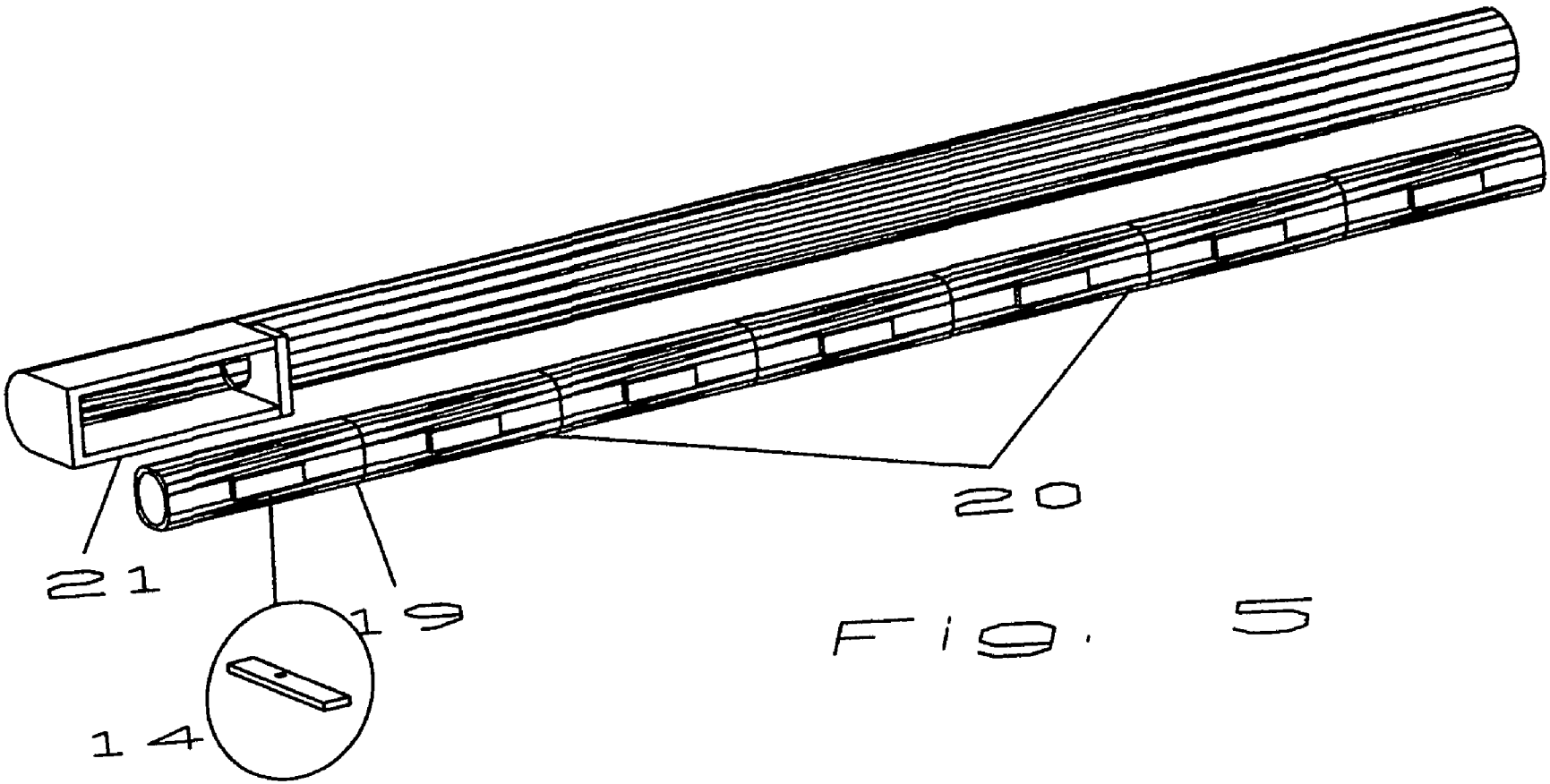
FIG. 5 is a representation of a firearm that loads caseless cartridges into a side loading firing chamber.

The method (FIG. 5) detailed in the preferred embodiment and the above embodiment but with end-to-end caseless cartridges (19) sequentially thrust by small individual propelling charges (in scaled popout 14) from a magazine stack (20) beside the barrel to load them from the side into a side entry firing chamber (21).

Figure 6:
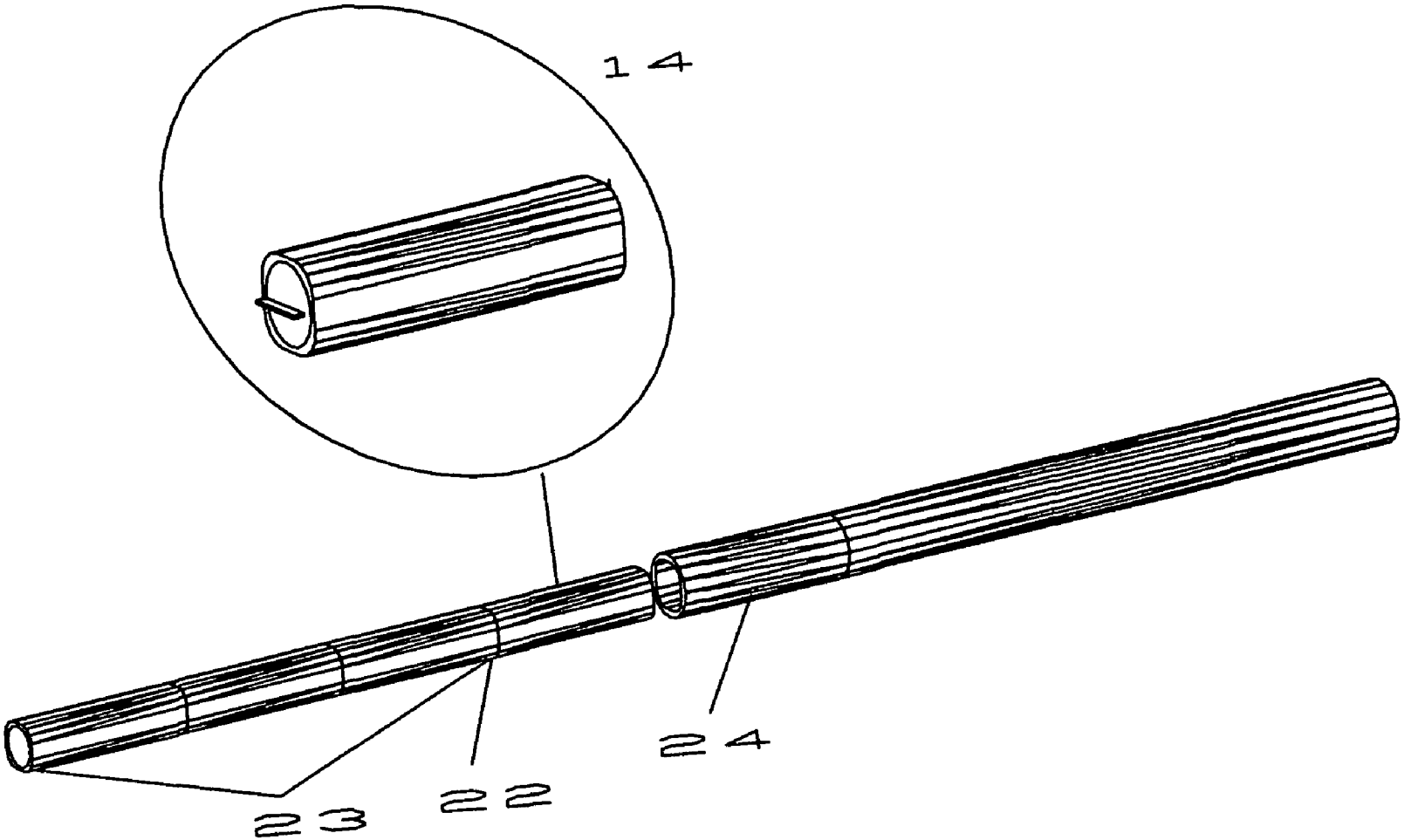
FIG. 6 is a representation of a firearm that loads caseless cartridges in a linear path into a rear loading firing chamber.

The method (FIG. 6) detailed in the previous embodiments paragraphs above but with end-to-end caseless cartridges (22) thrust linearly, sequentially by small individual propelling charges (in scaled popout 14) from a magazine stack (23) in line behind the firing chamber to load them into a rear entry firing chamber (24).

Figure 7:
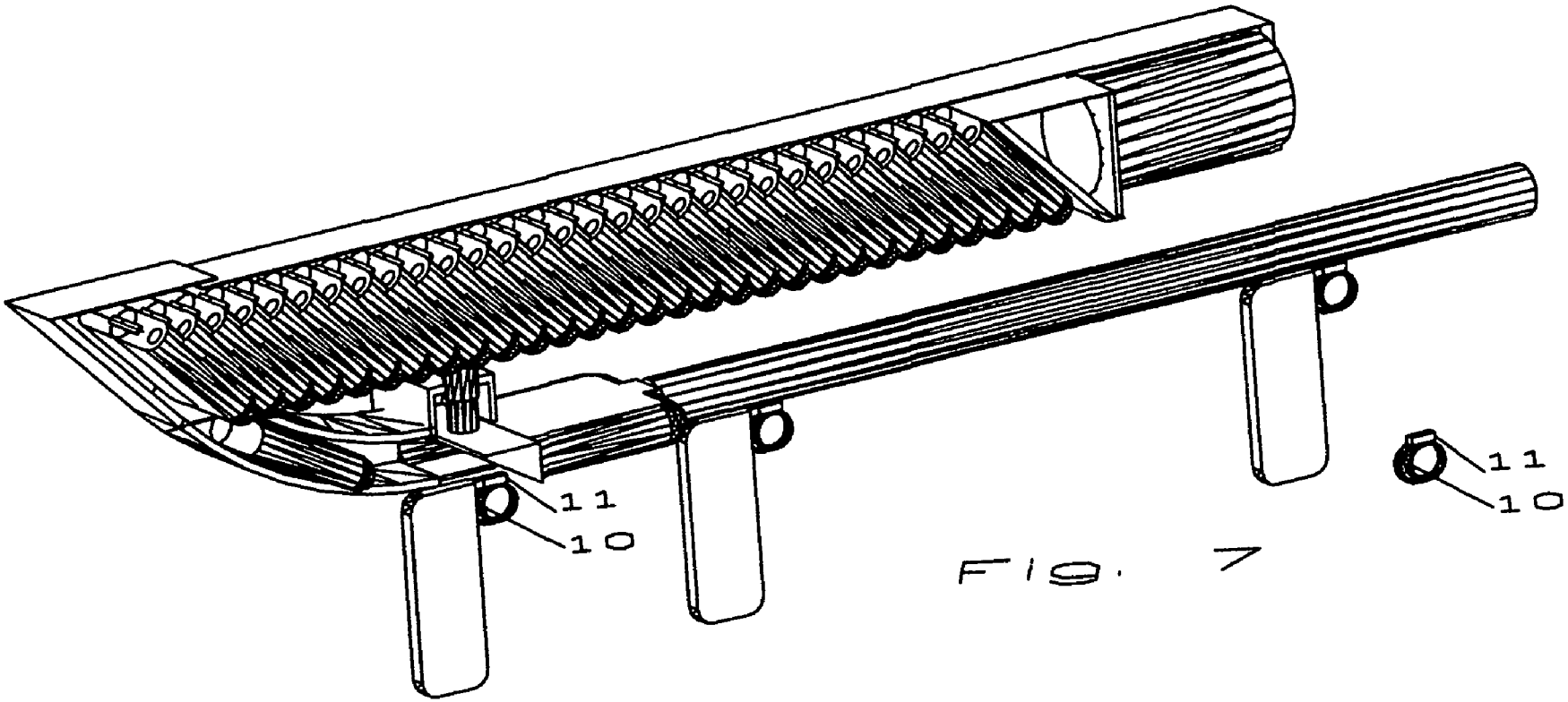
FIG. 7 is a representation of triggers located in various alternate ergonomic locations.

The method (FIG. 7) detailed in the previous embodiments paragraphs above but with triggers and firing impulse senders (10 and 11) located in various alternate ergonomic locations including a remote trigger and firing impulse sender located apart from the firearm to be actuated by an unoccupied hand. Therefore only the person possessing the remote trigger can fire said firearm, also hand motion of said unoccupied hand has no effect on aim or accuracy of the firearm.

The method (FIG. 7) in which any firearm of any design and manufacture meant to be carried and fired by hand has the trigger thereon removed and replaced by a triggering actuator triggered by an encrypted electronic signal transmitted by said remote trigger and firing impulse sender. Therefore only the person possessing the remote trigger can fire said firearm, also hand motion of said unoccupied hand has no effect on aim or accuracy of the firearm.

The invention claimed is:

1. A method of loading individual caseless cartridges into a firearm firing chamber by means of the expansive force of a small detonation on the rear of a foremost cartridge in a magazine as a means to propel that cartridge through a loading ramp into said firing chamber.

2. The method of claim 1 in which cartridges are stacked in a magazine with projectiles nearly touching, said cartridge comprising a cylindrical projectile encased in propellant in a flattened configuration about the cylindrical projectile as a means to shorten the cartridge stack.

3. The method of claim 1 in which cartridges are in a magazine oriented parallel to the barrel with cartridges stacked at approximately a 45 degree angle to the barrel requiring them to rotate thru approximately another 45 degrees as they pass in a curvilinear path through said loading ramp to insert into the firing chamber.

4. The method of claim 1 in which said cartridges thrust by said expansive force with sufficient momentum as a means to wedge open a spring loaded biased closed breach block and pass into the firing chamber allowing the breach block to close behind the cartridge.

5. The method of claim 1 in which cartridges pass a spring loaded breach block previously opened by means of a pneumatic actuator actuated by propellant gas tapped from the barrel during a prior firing, whereupon the further passage of the cartridge trips a sear as a means to close the breach block.

6. The method of claim 1 in which end to end caseless cartridges are sequentially thrust by small individual propelling charges from a magazine stack beside the barrel as a means to load them from the side into a side entry firing chamber.

7. The method of claim 1 in which end to end caseless cartridges are thrust linearly, sequentially, by small individual propelling charges from a magazine stack in line behind the firing chamber as a means to load them into a rear entry firing chamber.

8. The method of claim 1 providing a firearm triggered by an encrypted electronic signal transmitted by a trigger and firing impulse sender.

9. The method of claim 1 providing said firearm trigger and firing impulse sender located in various alternate ergonomic locations on the firearm.

10. The method of claim 1 providing a remote trigger and encrypted firing impulse sender located apart from the firearm;

whereby only the person possessing said remote trigger can fire, said firearm; and thereby any motion at the remote trigger, has no affect on aim or accuracy of the firearm.

* * * * *